US006109328A

United States Patent [19]

Montana et al.

[11] Patent Number: 6,109,328

[45] Date of Patent: Aug. 29, 2000

[54] SCREEN DOOR PROTECTOR

[76] Inventors: Peter A. Montana, 33 Association Rd.; Peter B. Walsh, 30 Susan Dr., both of Bellport, N.Y. 11743

[21] Appl. No.: 08/422,348

[22] Filed: Apr. 14, 1995

[51] Int. Cl.[7] ..... E06B 3/32

[52] U.S. Cl. ..... 160/92; 49/62; 49/168

[58] Field of Search ..... 160/92, 90, 91, 160/96; 49/62, 67, 168, 169

[56] References Cited

U.S. PATENT DOCUMENTS

| | | | |
|---|---|---|---|
| 236,532 | 1/1881 | Bassett | 160/96 |
| 1,100,564 | 6/1914 | Heryford | 160/96 X |
| 1,415,854 | 5/1922 | Abramson | 160/96 |
| 1,690,094 | 11/1928 | Beers | 160/92 X |
| 2,219,344 | 10/1940 | Taylor | 160/92 X |
| 2,286,899 | 6/1942 | Crescentini | 160/91 X |
| 2,396,648 | 3/1946 | Gould | 160/92 X |
| 2,434,859 | 1/1948 | McLoughlin | 160/92 |
| 2,604,156 | 7/1952 | Lillethorup | 160/92 |
| 2,884,051 | 4/1959 | Hollingsworth | 160/92 |
| 2,975,830 | 3/1961 | McDonald | 160/92 |
| 3,084,737 | 4/1963 | Stevens | 160/91 |
| 4,271,892 | 6/1981 | Brusseau et al. | 160/92 |

*Primary Examiner*—David M. Purol
*Attorney, Agent, or Firm*—Galgano & Burke

[57] ABSTRACT

One aspect of the present invention is directed to a screen door comprising a flexible screen and a rigid transparent protective cover disposed in at least partially overlapping relation with the flexible screen in order to protect the screen from damage. The cover is advantageously transparent in order to permit a person to see through both the screen and the cover. Furthermore, the cover is advantageously provided with a plurality of air holes.

16 Claims, 1 Drawing Sheet

SCREEN DOOR PROTECTOR

The present invention is directed to doors and, more particularly, to screen doors comprising a protective cover.

BACKGROUND OF THE INVENTION

Screen doors are widely used throughout areas having temperate environments. Screen doors offer the advantages of permitting fresh air to circulate freely while keeping insects and rodents from entering through the doorway. Screen doors also advantageously permit people to observe things on the other side of the screen without opening the screen door.

A common problem experienced with screen doors is that the screens tend to wear quickly. The screens often tend to tear, particularly in areas close to where the screen is supported by a frame. One common cause of excessive wear leading to early failure of a screen is pressure by small children and/or pets, such as dogs and cats. Once a screen is damaged, it no long serves as an effective barrier to insects and rodents. Furthermore, damaged screens are unsightly.

It would therefore be desirable to provide a screen door which advantageously permits the free circulation of air through the screen and permits an observer on one side of the screen to view things on the other side of the screen, but has increased wear capabilities.

It would also be desirable to provide a screen door which is not readily subject to damage by children and pets but which offers air circulation and is transparent.

SUMMARY OF THE INVENTION

One aspect of the present invention is directed to a screen door comprising a flexible screen, which is preferably supported by a frame, and a rigid transparent protective cover disposed in at least partially overlapping relation with the flexible screen in order to protect the screen from damage. The cover is advantageously transparent in order to permit a person to see through both the screen and the cover. Furthermore, the cover is advantageously provided with a plurality of air holes positioned over substantially the entire portion of the cover which overlaps the flexible screen in order to permit the free flow of fresh air through both the screen and the protective cover.

According to one embodiment of the present invention, the protective cover overlaps substantially all of the flexible screen on a screen door.

According to a further illustrated embodiment of the present invention, the protective cover overlaps only a portion of the flexible screen, for example, the lower half of the screen where damage from children and pets is most likely to occur.

These and other embodiments are described in further detail below with reference to the drawings.

DETAILED DESCRIPTION

Figure 1:
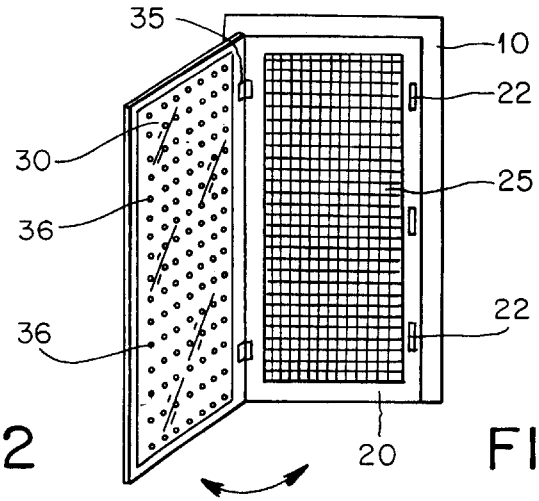
FIG. 1 illustrates a first embodiment of the present invention with the protective cover in an open position.

The present invention is directed to a novel screen door and a novel protective cover for screens of screen doors. According to one embodiment of the present invention illustrated in FIG. 1 a doorway 10 comprises a screen door having a frame 20 and a screen 25, and a protective cover 30 connected by hinges 35 to the screen door. According to this embodiment of the present invention, the protective cover 30 overlaps substantially all of the screen 25. While the protective cover 30 in this embodiment of the present invention is movably connected to the screen door to facilitate cleaning, in normal use, the protective cover is preferably fixed to the screen door with latches 22 (not shown) so that a person desiring to pass through the doorway can move both the screen door and the protective cover 30 with one motion. It is also desirable to keep the protective cover 30 attached to the screen door so that children and pets will not move the protective cover away from the screen 25 and then damage the screen 25.

The protective cover 30 is advantageously transparent and is also provided with air holes 36 in order to permit the free flow of fresh air through both the protective cover 30 and the screen 25. The air holes 36 are most preferably positioned over substantially the entire portion of the cover 30 which overlaps screen 25. Air holes 36 can be arranged with any desired spacing, diameter and pattern. Thus, while the illustrated embodiment of the present invention have generally circular holes passing through the protective covers, it is also possible to use holes of different shapes and sizes. However, in order to maintain the advantageous circulation aspects of the screen 25, there should be a sufficient number of air holes 36 to provide adequate ventilation.

Figure 2:
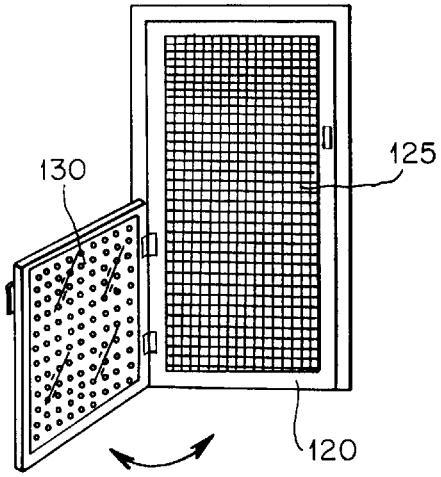
FIG. 2 illustrates an alternative embodiment of the present invention in an open position.
Figure 3:
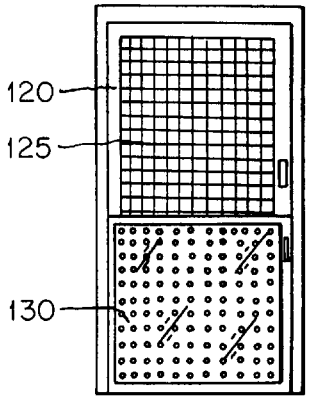
FIG. 3 illustrates the embodiment of the present invention shown in FIG. 2 in a closed position.
Figure 4:
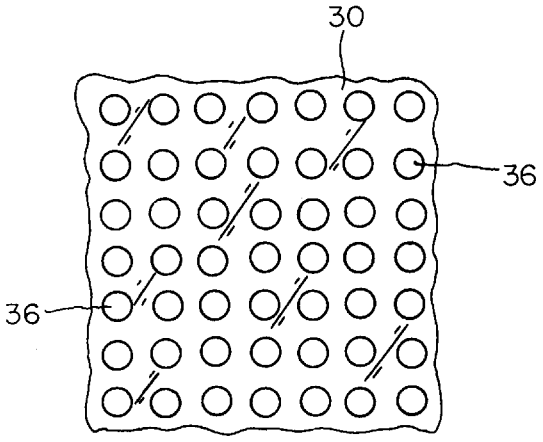
FIG. 4 is a partial, perspective view of a portion of a protective cover of the present invention.

According to a further embodiment of the present invention, a protective cover 130 is smaller than the screen 125 of a screen door 120. According to this embodiment of the present invention which is shown in FIGS. 2 and 3, the protective cover 130 protects only the lower portion of the screen 125. According to this embodiment, there is absolutely no detraction from the free circulation and fresh air and visibility in the upper part of the doorway. Nonetheless, the protective cover 130 advantageously protects the lower portion of the screen 125 which is particularly vulnerable to damage from children and pets. FIG. 3 illustrates protective cover 130 in its normal, "protecting" position, while FIG. 2 shows the protective cover 130 in an open position for cleaning.

While the illustrated embodiments of the present invention show protective coverage directly connected to screens with hinges, it is also within the scope of the present invention to position the protective covers proximate the screens in a variety of different ways. For example, the protective covers can be snap fit or held in place with a releasible fastener such as Velcro. In this manner, the coverage and screens can be readily separated for cleaning and storage. In certain circumstances, it may be desirable for some people to utilize a protective cover only when the potential for damage to the screen is increased, for example, by the presence of children or adverse weather conditions.

It is also within the scope of the present invention to utilize the protective cover 30 as a safety barrier wherein the cover is formed of suitable impact resistant material such as Lexan® and is securely attached to a screen.

It will also be appreciated that the protective cover can cover more than the portion illustrated in FIG. 3 without covering the entire screen as shown in FIG. 1. For example, in certain circumstances, it may be desirable to provide about 80% coverage while in other instances it will be desirable to provide about 40 to 60% coverage.

Figure 5:
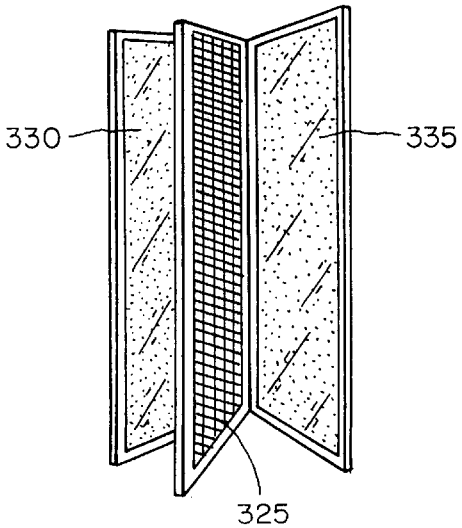
FIG. 5 illustrates an alternative embodiment of the present invention with a plurality of protective covers.

According to a still further embodiment shown in FIG. 5, a screen 325 has both sides protected by forward protective cover 330 and rearward protective cover 335.

What is claimed is:

1. A screen door comprising:

a flexible screen supported by a frame; and a first rigid, transparent protective cover having at least a portion disposed proximate to and in overlapping relation with said flexible screen, said cover comprising a plurality of air holes positioned in the overlapping portion of said cover.

2. A screen door according to claim 1 wherein said cover is supported by said frame.

3. A screen door according to claim 1 wherein said cover is movably connected to said frame.

4. A screen door according to claim 1 wherein said cover portion overlaps substantially all of said flexible screen.

5. A screen door according to claim 1 wherein said cover portion overlaps less than 80% of said flexible screen.

6. A screen door according to claim 1 wherein said cover portion overlaps about 40–60% of said flexible screen.

7. A screen door according to claim 1 wherein said cover is disposed in a fixed position relative to said screen.

8. A screen door according to claim 1 further comprising a second protective cover disposed on a side of said screen opposite said first cover.

9. A screen door according to claim 1 wherein said cover is releasably connected to said frame.

10. A screen door according to claim 1 wherein said air holes are positioned over substantially the entire overlapping portion of said cover.

11. A screen door according to claim 1 wherein said air holes are arranged to provide ventilation over substantially the entire cover.

12. A screen door according to claim 1 wherein said cover is formed of an impact resistant material.

13. A screen door according to claim 3 wherein said cover is movably connected to said frame by hinges.

14. A screen door according to claim 13 wherein said cover is selectively positioned relative to said screen by latches.

15. A screen door according to claim 7 wherein said cover is in a fixed position relative to said screen by a releasable fastener.

16. A screen door according to claim 7 wherein said cover is connected to said screen by a snap fit.

* * * * *